US005201166A

United States Patent [19]

Johnsen

[11] Patent Number: 5,201,166

[45] Date of Patent: Apr. 13, 1993

[54] BAG HANDLING MACHINE

[75] Inventor: Hugo Johnsen, Campbellville, Canada

[73] Assignee: Johnsen Machine Company Ltd., Burlington, Canada

[21] Appl. No.: 855,824

[22] Filed: Mar. 23, 1992

[51] Int. Cl.[5] ..... B65B 43/18; B65B 43/46; B65B 39/02

[52] U.S. Cl. ..... 53/571; 53/386.1; 141/114; 141/313

[58] Field of Search ..... 53/571, 573, 384.1, 53/386.1, 459; 141/313, 314, 114

[56] References Cited

U.S. PATENT DOCUMENTS

| | | | |
|---|---|---|---|
| 2,950,589 | 8/1960 | Litchard | 53/386.1 X |
| 3,208,194 | 9/1965 | Johnson et al. | 53/571 |
| 3,427,780 | 2/1969 | Bock | 53/573 X |
| 3,501,893 | 3/1970 | Peterson | 53/573 |
| 3,566,578 | 3/1971 | Thorne et al. | 53/573 X |
| 3,830,038 | 8/1974 | Propst | 53/386.1 X |
| 3,943,687 | 3/1976 | Cerioni | 53/571 |
| 4,078,358 | 3/1978 | Henderson | 53/573 X |
| 4,320,615 | 3/1982 | Gmür | 53/573 X |
| 4,432,186 | 2/1984 | McGregor | 53/573 X |
| 4,729,209 | 3/1988 | Owensby et al. | 53/573 X |

*Primary Examiner*—Horace M. Culver
*Attorney, Agent, or Firm*—Rodgers & Scott

[57] ABSTRACT

Bag handling apparatus for sequentially selecting bags from a supply thereof and positioning them for subsequent opening and filling has a vertically-movable slider positioned above a stack of horizontal closed bags. A carriage is pivotally secured to the slider and by links to a fixed point. Upward movement of the slider causes the carriage to be moved angularly from a downwardly directed position adjacent the stack of bags enabling the carriage to pick up a horizontal top bag to a forwardly directed position to cause the carriage to present the bag in a vertically-oriented position for subsequent opening and filling.

10 Claims, 6 Drawing Sheets

BAG HANDLING MACHINE

This invention relates to bag handling apparatus for sequentially selecting bags from a supply thereof and sequentially positioning and opening the bags for subsequent filling. Some bags, for example certain types of plastic bags, sequentially selected from a vertically-oriented supply thereof at a positioning and opening station. However, some bags such as certain types of paper bags cannot readily be sequentially selected from a vertically-oriented supply thereof.

It is therefore an object of the present invention to provide improved bag handling apparatus for use with bags which cannot be readily sequentially selected from a vertically-oriented supply thereof.

The invention is especially useful with a baling machine in which a number of packages are dropped into each open bag, one example of such a baling machine being shown in U.S. Pat. No. 5,117,614 issued Jun. 2, 1992, the contents of which are hereby incorporated herein by reference. However, it will be understood that the present invention is not limited to use with such a baling machine.

According to the invention, bag handling apparatus comprises a vertically movable slider above a stack of substantially horizontal closed bags, means for guiding the slider in a vertical path, the slider carrying a carriage pivotally secured to the slider, the carriage having means for engaging a bag and retaining the bag in engagement therewith, means for moving the slider vertically upwardly and downwardly along said vertical path, and link means pivotally connecting the carriage to a fixed point to cause the carriage to be moved angularly, by upward movement of the slider, from a downwardly directed position adjacent the stack of bags, thereby enabling the bag engaging means to engage and retain a substantially horizontal top bag to a forwardly directed position to cause the carriage to present the bag engaged and retained by the bag engaging means in a vertically oriented position for subsequent opening and filling.

The means for moving the slider vertically upwardly and downwardly along said vertical path may comprise lever means pivotally connected at one end to the slider and pivotally connected at an opposite end to one end of second link means whose other end is pivotally connected to a further fixed point.

The means for moving the slider vertically upwardly and downwardly along said vertical path may include extendable and contractable means pivotally connected between a third fixed point and a medial portion of the lever means.

The carriage may include means for extending and retracting the means for engaging and retaining a bag. The means for engaging and retaining a bag may comprise suction means.

The bag handling apparatus may also include further bag engaging and retaining means located at a position to engage and retain a bag at said vertically oriented position and thereby enable said means on said carriage for engaging a bag and retaining the bag in engagement therewith to release a bag retained by said further bag engaging and retaining means and permit the carriage to be moved angularly back to its downwardly directed position to pick up another bag from said stack. The further bag engaging and retaining means may comprise suction means.

The bag handling apparatus may also include additional bag engaging and retaining means, operable and movable to engage a portion of a bag held by said further bag engaging and handling means and open said bag. The additional bag engaging and retaining means may comprise suction means.

The bag handling apparatus may also include bag equipping means comprising a plurality of opening members movable into an open upper end of a bag and a corresponding plurality of retainer members movable into engagement with the outside of the bag so that the upper open end portion of the bag is gripped between pairs of opening members and retaining members.

The present invention also provides bag handling apparatus for sequentially selecting bags from a supply thereof and positioning them for subsequent opening and filling, said apparatus comprising means for engaging and retaining a horizontal bag on the top of a stack of horizontal closed bags and angularly moving said bag to a vertically-oriented position for subsequent opening and filling, and further bag engaging and retaining means located at a position to engage and retain a bag in said vertically-oriented position and thereby enable said first mentioned bag engaging and retaining means to release the bag, when said bag has been engaged and retained by said further bag engaging and retaining means, and permits said first mentioned bag engaging and retaining means to operate to pick up another bag from said stack.

Bag handling apparatus in accordance with a preferred embodiment of the present invention will now be described, by way of example, with reference to the accompanying drawings, in which.

Figure 1:
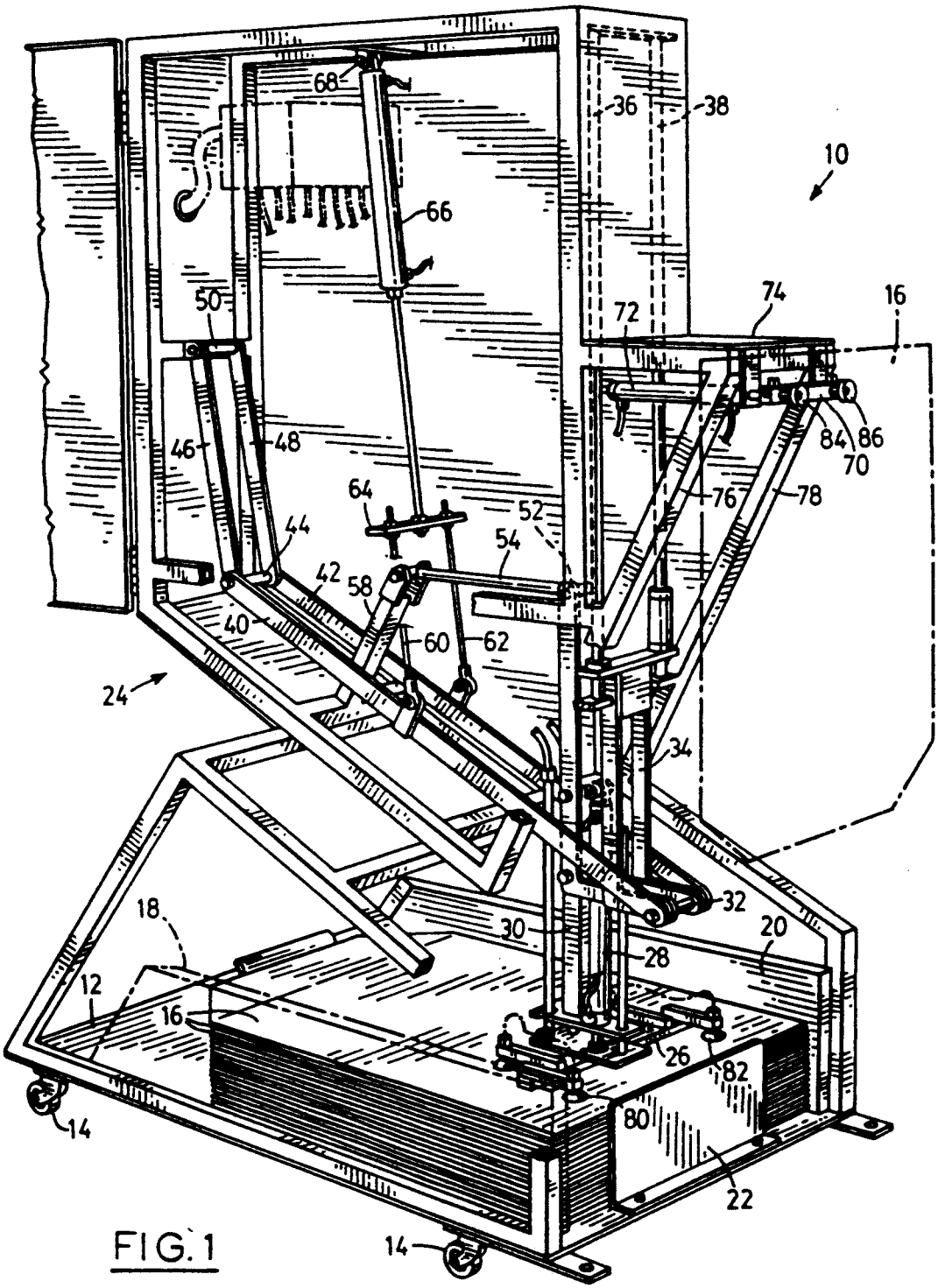
FIG. 1 is a perspective view of the portion of the bag handling apparatus which sequentially selects bags from a stack thereof and positions them in a vertically-oriented position for sequential opening and filling, the apparatus being shown with its parts positioned to pick up a bag from the stack.

Referring first to FIG. 1, the portion 10 of the bag handling apparatus which sequentially selects bags from a stack thereof and positions them in a vertically oriented position for subsequent filling includes a rectangular platform 12 mounted on castors 14 for mobility. In use, a stack of horizontal paper bags 16 in flat closed configuration is positioned on the platform. The platform 12 has side walls 18, 20 and a front stop 22 to retain the bags in position. A frame carried by the platform 12 and indicated generally by the reference numeral 24 supports the various parts of the portion 12 of the bag handling apparatus which will now be described.

Figure 2:
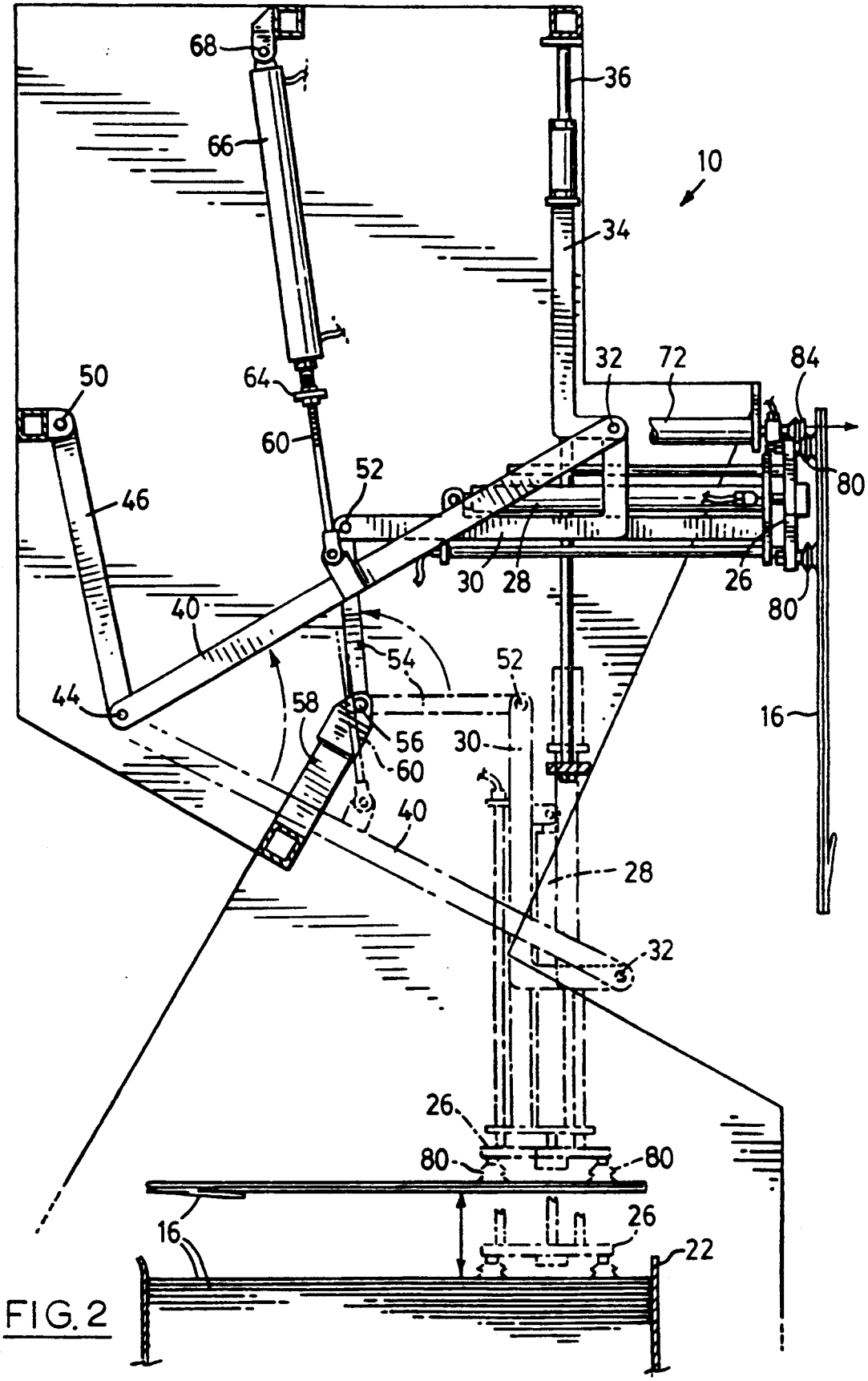
FIG. 2 is a side view of parts of the bag handling apparatus shown in FIG. 1, the parts being shown in dotted outline in the position shown in FIG. 1 and full lines with a bag positioned in a vertically-oriented position for subsequent opening and filling.

A first suction cup carrier 26 is mounted for pivotal movement between a lower downwardly-directed vertical position engaging the top bag 16 of the stack shown in FIG. 1 and an upward forwardly-facing horizontal position shown in full lines in FIG. 2. The carrier 26 is mounted on the piston rod end of a hydraulic cylinder 28 whose cylinder is secure to a carriage 30. The carriage 30 is pivotally mounted by means of a horizontal hinge pin 32 on a slider 34 which is mounted for vertical sliding movement on two vertical guide rods 36, 38 at the front of frame 24.

Hinge pin 32 also pivotally connects the forward ends of two parallel levers 40, 42 to the carriage 30 and slider 34. The rear ends of levers 40, 42 are pivotally connected by horizontal hinge pin 44 to the lower ends of two parallel links 46, 48 whose upper ends are pivotally connected by horizontal hinge pin 50 to the frame 24.

The end of the carriage 30 remote from suction cup head 26 is pivotally connected by horizontal hinge pin 52 to the free end of a link 54. The other end of link 54 is pivotally connected by horizontal hinge pin 56 to the upper end of a frame member 58 which extends upwardly from a lower part of the frame 24.

The levers 40, 42 are pivotally connected at positions near their midpoints to the lower ends of two rods 60, 62 whose upper ends are connected to a cross member 64 secured to the piston rod of a hydraulic cylinder 66. The cylinder end of hydraulic cylinder 66 is pivotally connected by horizontal hinge pin 68 to an upper part of the frame 24.

A second suction cup carrier 70 is mounted on the piston rod of a hydraulic cylinder 72 whose cylinder end is secured to a support member 74 projecting forwardly from a front upper part of the frame 24. The support member 74 is braced by two frame members 76, 78.

The suction cup head 26 carries two pairs of suction cups 80, 82 and the suction cup head 70 carries two suction cups 84, 86. It will be understood that the suction cups 80, 82 and 84, 86 will be connected to a suitable suction source and appropriate controls, and that the hydraulic cylinders 28, 64 and 72 will be connected to a suitable hydraulic source and appropriate controls to enable the operation of this portion of the bag handling apparatus (which will be described later) to be effected.

Referring again to FIGS. 1 and 2, FIG. 1 shows the portion 10 of the bag handling apparatus picking up the top bag 16 from the stack on the platform 12. Hydraulic cylinder 28 is partially extended a sufficient amount to cause suction cups 80, 82 to engage the top bag 16 in the stack. When the suction cup carrier 16 is in the required position as shown in FIG. 1, the suction cups 80, 82 are activated to cause the top bag 16 to be held thereby. The suction cups 80, 82 engage a side of the bag 16 near its open end (which is adjacent the front stop 22). At this stage, the hydraulic cylinder 72 is fully contracted and the hydraulic cylinder 64 is fully extended.

Hydraulic cylinder 64 is then contracted to cause movement of the suction cup carrier 26 to the position shown in FIG. 2. During contraction of hydraulic cylinder 64, the front ends of levers 40, 42 pivot upwardly to slide the slider 34 up the guide rods 36, 38. Since the front ends of levers 40, 42 are caused by their attachment to slider 34 to remain in the same vertical plane, the rear ends of levers 40, 42 are permitted to move rearwardly and then forwardly by pivotal movements of links 46, 48. As the slider 34 is moved up the guide rods 36, 38 in a vertical path, the attachment of link 54 to the fixed pivot point provided by pivot pin 56 causes the carriage to rotate from the lower downwardly-directed orientation shown in FIG. 1 to the upper forwardly-directed orientation shown in FIG. 2. As the carrier 30 is rotating, hydraulic cylinder 30 is contracted. The top bag 16 is accordingly carried by the suction cup carrier 26 from the top of the stack as shown in FIG. 1 to a vertical position as shown in FIG. 2.

The suction cups 84, 86 on the second suction cup carrier 70 are then activated and the suction cups 80, 82 on the first suction cup carrier 26 are de-activated so that the bag 16 in FIG. 2 is now held by suction cups 84 and not by the suction cups 80, 82. The hydraulic cylinder 62 is then extended to return the suction cup carrier 26 to the position shown in FIG. 1 to pick up the next bag 16 from the stack. FIG. 2 shows in dotted outline the manner in which the vertical position of suction cup carrier 26 is adjustable by partial extension of hydraulic cylinder 28 so that the suction cups 80, 82 can engage the top bag 10 of the stack.

Figure 3:
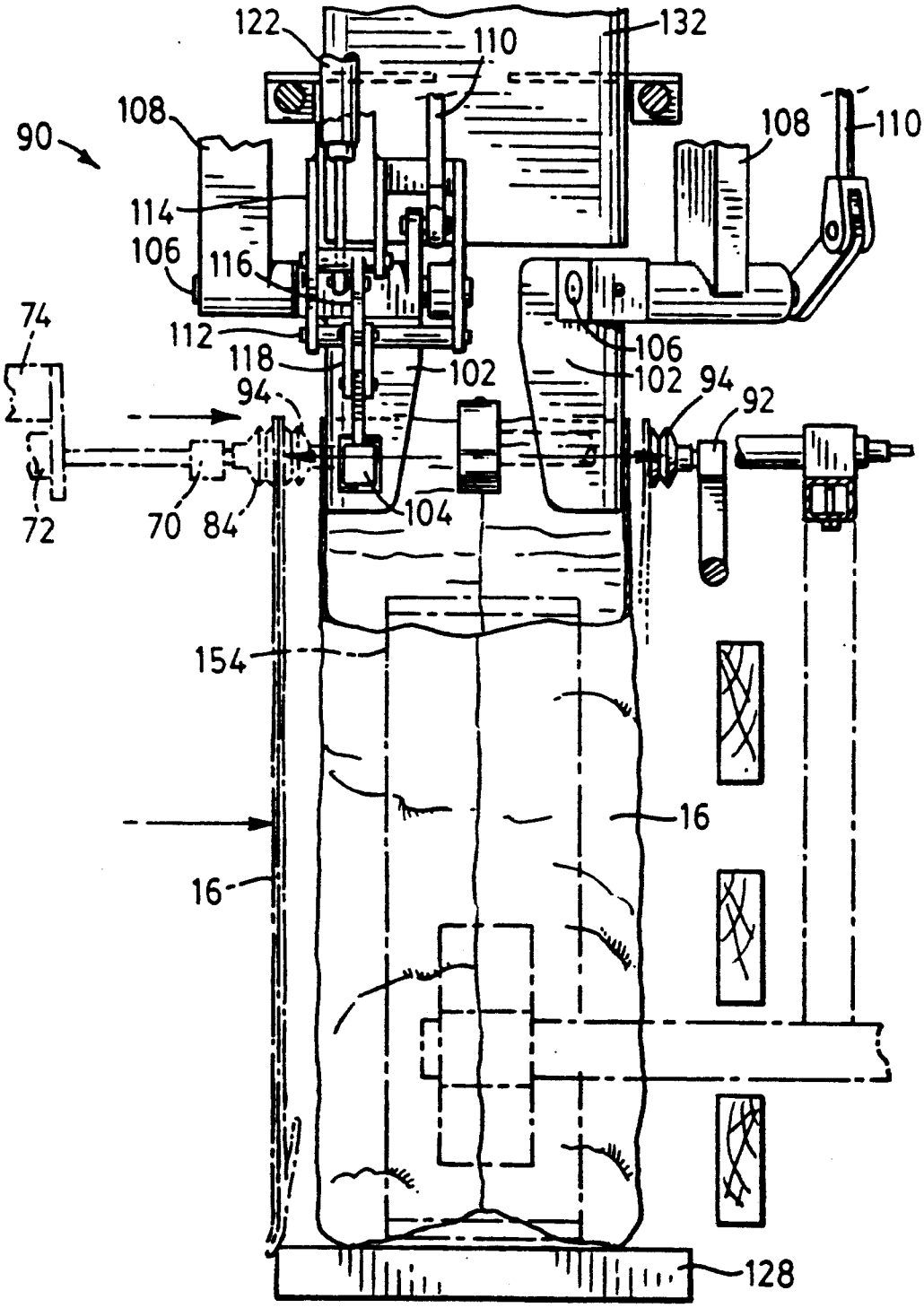
FIG. 3 is a side view of the portion of the bag handling apparatus which opens the bag positioned as shown in FIG. 2 for subsequent filling.
Figure 4:
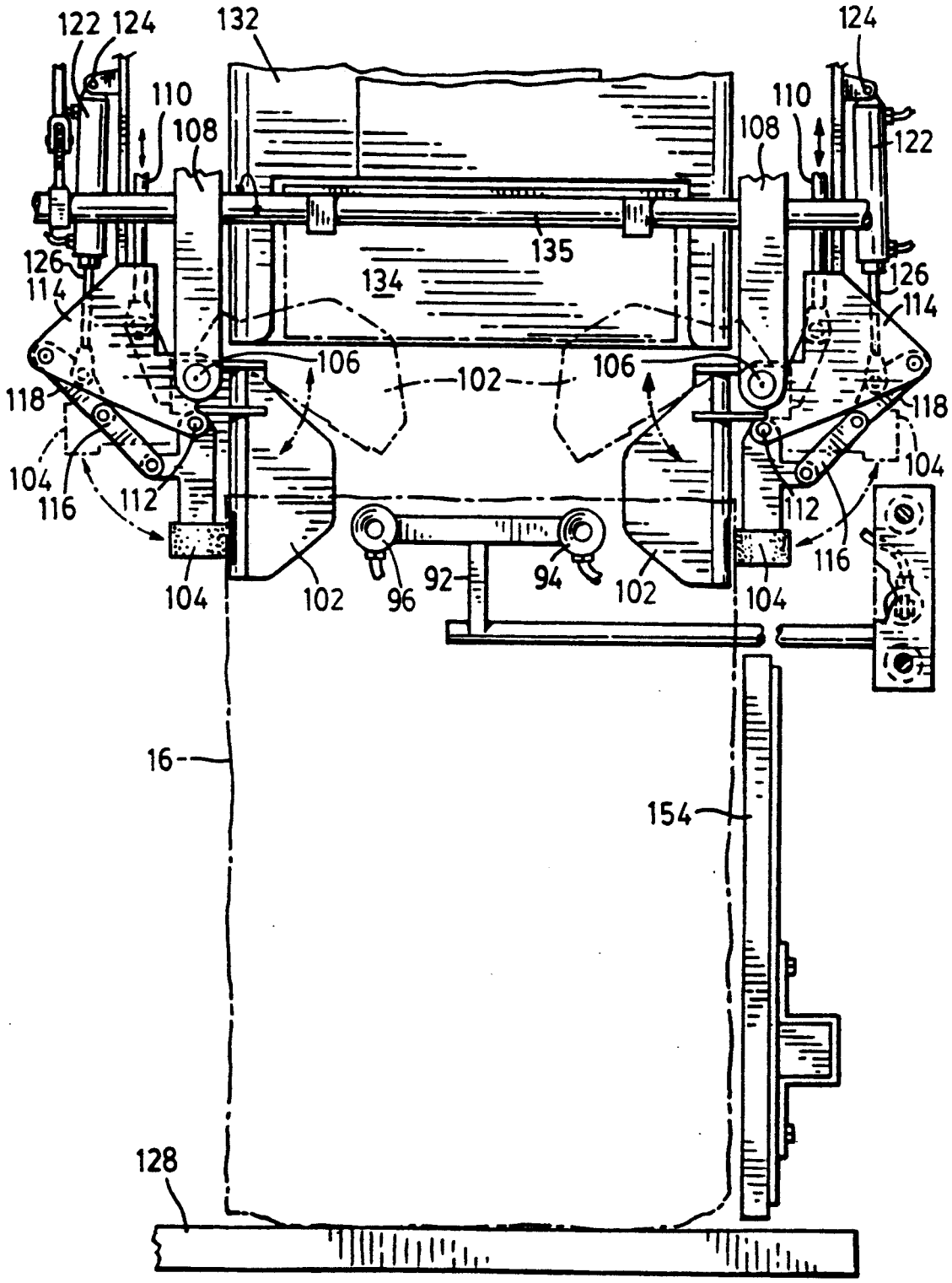
FIG. 4 is a rear view of the portion of the bag handling apparatus shown in FIG. 3.

While the suction cup carrier 26 is picking up another bag 16, the bag 16 held by suction cup 84 is moved by extending hydraulic cylinder 72 to a portion 90 of the bag handling apparatus shown in FIGS. 3 and 4. The portion 90 has a further suction cup carrier 92 with two suction cups 94, 96 movable by actuation of a hydraulic cylinder (not shown) towards and away from the suction cup holder 70. After cylinder 72 has been extended as previously described to position bag 16 as shown in dotted outline in FIG. 3, suction cup carrier 92 is moved by its hydraulic cylinder from the position shown in full lines in FIG. 3 to the position shown in dotted lines on the opposite side of bag 16 to the suction cup 84. Suction cups 94, 96 are then actuated and suction cup carrier 92 is retracted to the position shown in full lines in FIG. 3, thereby opening the bag 16.

Referring now to FIGS. 3 and 4, mechanism to hold the bag 16 open for subsequent filling is now actuated. Four sets of openers 102 and retainers 104 are provided and positioned so that the bag 16 can be opened to a rectangular configuration.

Each opener 102 is pivotally mounted at 106 on a frame member 108 and is movable by operation of a hydraulic cylinder, the piston rod 110 of which is shown between a retracted position shown in dotted outline and an opening position shown in full lines. Each retainer 104 is pivotally mounted at 112 on a frame mamber 114. A linkage comprising two pivotally connected links 116, 118 is pivotally connected to the retainer 104, frame member 114. The hydraulic cylinder 122 pivotally connected to the frame at 124 has its piston rod 126 pivotally connected to the link 116. The hydraulic cylinder 122 is operable to move the retainer 104 between a retracted position shown in dotted lines and a retaining position shown in full lines.

When the suction cup carrier 92 is retracted to the position shown in full lines in FIG. 3, thereby opening the bag 16, the openers 102 and retainers 104 are in their retracted positions. The hydraulic cylinders controlling the openers 102 and retainers 104 are then actuated to move the openers 102 and retainers 104 to the postion shown in full lines in FIGS. 3 and 4. The openers 102 enter the open top of the bag and open it to a rectangular configuration. Retainers 104 engage the outside of the bag 16 and press the bag 16 against an adjacent opener 112 so that the bag 16 is firmly held between the retainers 104 and openers 102. The bottom of the bag is supported by a platform 128. Section cups 84, 86 and 94, 96 are de-activated at this time.

The bag 16 is then filled with packages 130, a chute 132 which has pivotally mounted doors 134 at its lower end, the doors 134 being mounted on a shaft 135 which can be rotated (by means not shown) to open and close the doors 134. The actual construction of the filling mechanism is not a feature of this invention and may be any suitable mechanism as will be apparent to a person skilled in the art. One suitable filling mechanism is described in U.S. Pat. No. 5,117,614 which has been referred to earlier.

Figure 5:
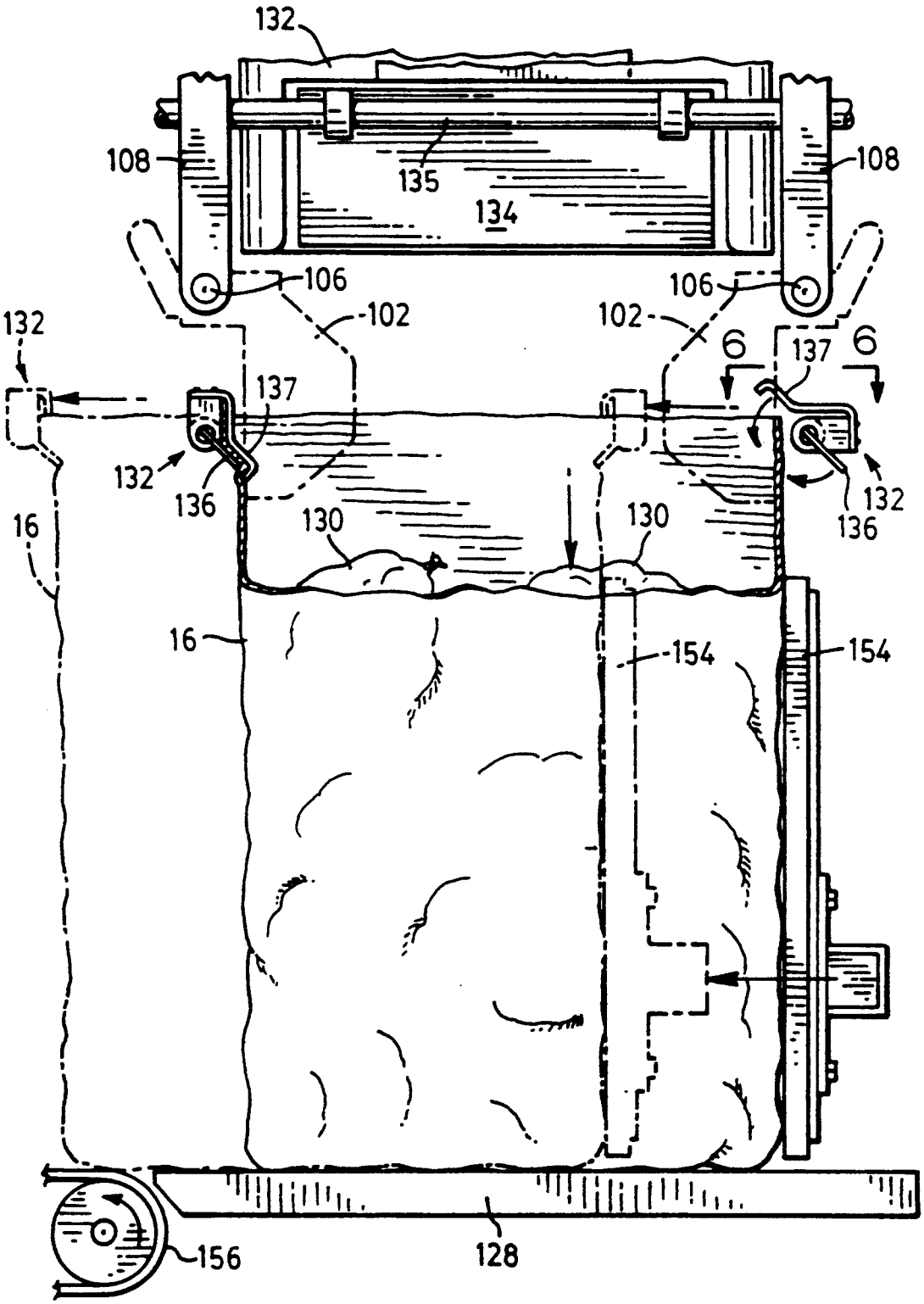
FIG. 5 is a rear view similar to FIG. 4 but showing the parts which move a filled bag away from the filling location.
Figure 6:
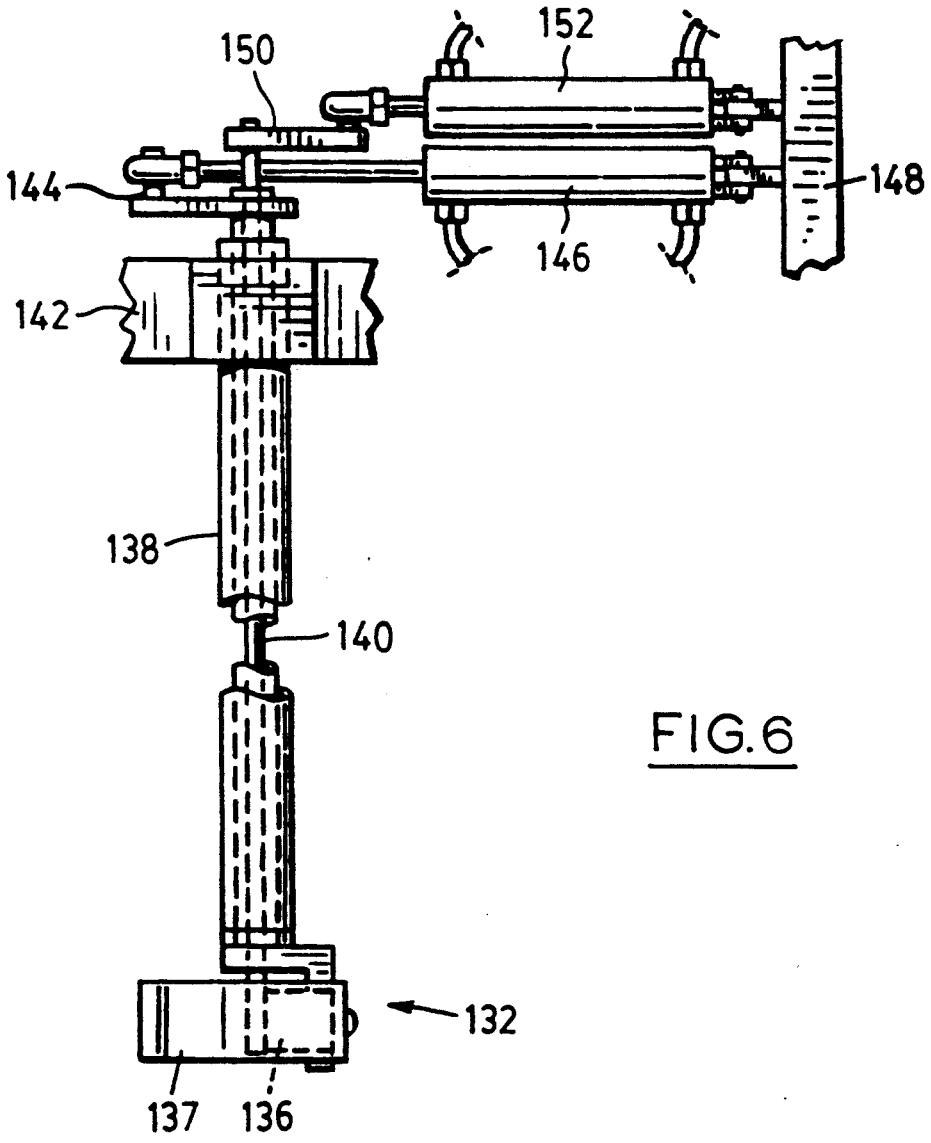
FIG. 6 is a sectional view taken along the line 6—6 of FIG. 5.

When the bag 16 has been filled with packages 130, and referring now to FIGS. 5 and 6, the openers 102 and retainers 104 are retracted and the upper edge portion of the bag 16 is gripped by grippers 132 which are mounted on a movable carriage (not shown). Each gripper 132 has an inner arm 137 and an outer arm 136. The inner arm 137 enters into the open top of the bag and the outer arm engages the outside of the bag 16 so that the upper edge portion of the bag 16 is gripped between the inner and outer arms 137, 136. FIG. 5 shows the gripper 132 on the left in the closed position and the gripper 132 on the right in the open position.

The inner arm 137 of each gripper 132 is mounted at one end of a sleeve 138 and the outer arm 136 mounted at one end of a shaft 140 which extends through the sleeve 138. The sleeve 138 is rotatably mounted in a carriage frame member 142. The sleeve 138 is connected at its other end through a pivoted linkage 144 to the piston rod of a hydraulic cylinder 146 connected to another carriage frame member 148. The shaft 140 is connected to at its other end through a pivoted linkage 150 to the piston rod of a further hydraulic cylinder 152 connected to the carriage frame member 148. The hydraulic cylinder 146 is operable to move the inner arm 137 between open and closed positions, and the hydraulic cylinder 152 is operable to move the outer arm 136 between open and closed positions.

The machine also has a pusher 154 located at one side of the bag 16 and which can be moved (by means not shown) from the full line position shown in FIG. 5 to the dotted line position and beyond to a filled bag 16 off the platform 128 onto a conveyor 156. At the same time, the carriage with the gripers 132 is moved likewise in the same manner. The conveyor 156 and the carriage move the bag 16 to a suitable bag closing station which may be of any suitable construction as will be readily apparent to a person skilled in the art.

A particular advantage of the invention, as can readily be observed from the foregoing description of a preferred embodiment, is that a bag 16 is removed from the horizontal stack by the portion 10 of the bag handling apparatus and presented in a vertical position for subsequent opening and filling while the preceding bag 16 is being filled, thereby enabling the operation to be carried out in a time efficient manner.

Other embodiments of the invention will be apparent to a person skilled in the art, the scope of the invention being defined in the appended claims.

We claim:

1. Bag handling apparatus for sequentially selecting bags from a supply thereof and positioning them for subsequent opening and filling, said apparatus comprising:

a vertically movable slider positionable above a stack of horizontal closed bags;

means for guiding the slider in a vertical path, said slider carrying a carriage pivotally secured to the slider;

said carriage having means for engaging a bag and retaining the bag in engagement therewith;

means for moving the slider vertically upwardly and downwardly along said vertical path; and link means pivotally connecting the carriage to a fixed point to cause the carriage to be moved angularly, by upward movement of the slide, from a downwardly directed position adjacent the stack of bags, thereby enabling the bag engaging means to engage and retain a horizontal top bag, to a forwardly directed position to cause the carriage to present a bag engaged and retained by the bag engaging means in a vertically oriented position for subsequent opening and filling.

2. Bag handling apparatus according to claim 1 wherein said means for moving the slider vertically upwardly and downwardly along said vertical path comprises lever means pivotally connected at one end to the slider and pivotally connected at an opposite end to one end of second link means whose opposite end is pivotally connected to a second fixed point.

3. Bag handling apparatus according to claim 2 wherein said means for moving the slider vertically upwardly and downwardly along said vertical path also comprises extendable and contractable means pivotally connected between a third fixed pivot and a medial portion of said lever means.

4. Bag handling apparatus according to claim 1 wherein said carriage includes means for extending and retracting said means for engaging a bag and retaining the bag in engagement therewith.

5. Bag handling means according to claim 1 wherein said bag engaging and retaining means comprises suction means.

6. Bag handling apparatus according to claim 1 also including further bag engaging and retaining means located at a position to engage and retain a bag in said vertically oriented position and thereby enable said means on said carriage for engaging a bag and retaining the bag in engagement therewith to release a bag retained by said further bag engaging and retaining means and permit the carriage to be moved angularly back to its downwardly directed position to pick up another bag from said stack.

7. Bag handling means according to claim 6 wherein said further bag engaging and retaining means comprises suction means.

8. Bag handling apparatus according to claim 6 also including additional bag engaging and retaining means operable and movable to engage a portion of the bag held by said further bag engaging and handling means and open said bag.

9. Bag handling apparatus according to claim 8 wherein said additional bag engaging and retaining means comprises suction means.

10. Bag handling apparatus according to claim 8 also including bag gripping means comprising a plurality of opening members movable into an open upper end of a bag and a corresponding plurality of retainer members movable into engagement with the outside of the bag so that the upper open end portion of the bag is gripped between pairs of opening members and retainer members.

* * * * *